US006619705B2

(12) United States Patent
Dalsing

(10) Patent No.: US 6,619,705 B2
(45) Date of Patent: Sep. 16, 2003

(54) MORTISE LOCKSET WITH INTERNAL CLUTCH

(75) Inventor: Troy A. Dalsing, Calhan, CO (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 10/038,540

(22) Filed: Jan. 4, 2002

(65) Prior Publication Data

US 2003/0127864 A1 Jul. 10, 2003

(51) Int. Cl.[7] ..... E05C 1/12

(52) U.S. Cl. ..... 292/169.14; 292/DIG. 27; 70/149; 70/422

(58) Field of Search ..... 292/169.14, 169.15, 292/169.17, DIG. 27; 70/149, 277, 422, 472

(56) References Cited

U.S. PATENT DOCUMENTS 3,808,849 A * 5/1974 Alexander ..... 70/149
5,044,184 A 9/1991 Herbers et al.
5,377,513 A 1/1995 Miyamoto et al.
5,474,348 A * 12/1995 Palmer ..... 292/339
5,640,863 A 6/1997 Frolov
5,896,764 A * 4/1999 Monsch ..... 70/107
6,145,353 A 11/2000 Doucet
6,354,121 B1 3/2002 Frolov

* cited by examiner

*Primary Examiner*—Gary Estremsky
(74) *Attorney, Agent, or Firm*—Michael Best & Friedrich LLP

(57) ABSTRACT

A lock mechanism has a locked condition and an unlocked condition and includes a housing. The lock mechanism also includes a latch that extends from the housing and has an extended position and a retracted position. The lock further includes a biasing member for biasing the latch to the extended position. The lock mechanism further yet includes a means for transferring an operator input motion to move the latch to the retracted position in the unlocked condition. The means for transferring an operator input motion includes uncoupling the operator input motion from the latch in the locked condition. The means for transferring also includes a locking driver and a locker. The locking driver includes a first surface and a second surface and the locker includes a biasing member for biasing the locker toward at least one of the first and second surfaces.

18 Claims, 8 Drawing Sheets

MORTISE LOCKSET WITH INTERNAL CLUTCH

FIELD OF THE INVENTION

This invention relates generally to mechanical locksets employed to secure doors. More particularly, the present invention relates generally to a mortise-type lockset that incorporates an internal clutch assembly.

BACKGROUND OF THE INVENTION

Recent hardware trends and the Americans with Disabilities Act requirements for lever handles at both exterior and interior sides of doors have focused the market on lever operated lock mechanisms. Because both intruders and users can impose greater forces on the lock mechanism having lever operating systems, it is particularly important to provide a mechanism that is not vulnerable to being compromised intentionally or otherwise. In some cases lever operated lock mechanisms have included a mechanical clutch mounted between the operator or operating lever and the lockset. Such clutches selectively mechanically couple the operating lever to the lockset and permit rotation of the operating lever to retract the latch or bolt and allow entry through the doorway.

An example of an electromechanical type of clutch may be found in U.S. Pat. No. 5,640,863. Such separate, add on clutches work well and have the advantage of being compatible with existing locksets, allowing existing key-based security systems to be retrofitted with electronic security capabilities. Purely mechanical clutch assemblies are typically used between a lever or operator and the bolt of a lockset. Typically, if the door is locked either with a thumb turn or a key, the clutch assembly uncouples the mechanical connection between the operator and the bolt. Thus, an intruder who attempts to use brute force to turn the operating lever will realize that no amount of force will withdraw the bolt and allow entry through the doorway secured by the lockset.

In some cases known clutch mechanisms have been vulnerable, particularly after years of service, due to wearing of the individual parts thereof. This may lead to mechanisms that jam and become inoperative. In some cases, however, wear of the components may result in malfunctions such as jamming or make the assembly inoperative and prevent access to the secured side of the door or even prevent egress from the secured side to the unsecured side.

SUMMARY OF THE INVENTION

The present invention provides a lock mechanism that has a locked condition and an unlocked condition. The lock mechanism includes a housing, a latch that extends from the housing and has an extended position and a retracted position, a biasing member for biasing the latch to the extended position, and means for transferring an operator input motion to move the latch to the retracted position in the unlocked condition. The means for transferring an operator input motion includes uncoupling the operator input motion from the latch in the locked condition. The means for transferring includes a locking driver and a locker. The locking driver includes a first surface and a second surface and the locker includes a biasing member for biasing the locker toward at least one of the first and second surfaces.

More particularly, the invention may provide the locking driver with at least one of the first and second surfaces defined therein. The first and second surfaces may be arced surfaces. The first and second surfaces may be generally concentric. The locker may be a first locker and the biasing member may be a first biasing member. The lock mechanism may include a second locker that may include a second biasing member for biasing the second locker toward the other of the first and second surfaces. The first locker may be biased in a first direction and the second locker may be biased in a second direction. The first and second direction may be substantially similar. The first locker may also include a first pin and the second locker may also include a second pin. The first biasing member may be disposed in a generally coaxial relationship with the first pin and the second biasing member may be disposed in a generally coaxial relationship with the second pin.

It is another feature of the present invention to provide a lock mechanism that has a locked condition and an unlocked condition. The lock mechanism includes a housing, a latch that extends from the housing and has an extended position and a retracted position, and a displaceable locking driver that has a first position corresponding to the unlocked condition and a second position corresponding to the locked position. The locking driver is operable to transfer operator input motion to move the latch to the retracted position in the first position. The locking driver is also operable to uncouple the operator input motion from the latch in the second position. The lock mechanism also includes a locker that is interconnectable with the locking driver and includes a biasing member for biasing the locker toward the locking driver.

A further feature of the present invention is to provide a lock mechanism that has a locked condition and an unlocked condition. The lock mechanism includes a housing, a latch that extends from the housing and has an extended position and a retracted position, and an operating lever operable to provide an operator input motion to move the latch to the retracted position in the unlocked condition. The operator input motion is uncouplable from the latch in the locked condition. The lock mechanism also includes a locking driver interconnectable with the housing. The locking driver includes a first surface and a second surface. At least one of the first and second surfaces is defined within the locking driver. The lock mechanism further includes a first locker interconnectable with the locking driver. The first locker includes a first biasing member that biases the first locker toward one of the first and second surfaces. The lock mechanism further yet includes a second locker that is interconnectable with the locking driver. The second locker includes a second biasing member that biases the second locker toward the other of the first and second surfaces.

Independent features and independent advantages of the invention will become apparent to those skilled in the art upon review of the detailed description and drawings.

DETAILED DESCRIPTION OF A PREFERRED EMBODIMENT

With reference to the drawings wherein like numerals represent like parts throughout the several figures, one embodiment of the mortise lockset or lock mechanism, in accordance with the present invention is generally designated by the numeral 20. The lock mechanism 20 is mountable in the mortise of a door (not illustrated) and is adapted to engage the strike of a doorframe (not illustrated). The lock mechanism 20 is equipped with both key and thumb turn locking assemblies disposed, respectively, on the outside (unsecured side) and the inside of the enclosure, such as a room, being secured by the lock mechanism 20. It will be understood that for the illustrated environment, the lock mechanism 20 is always unlocked from the secured side because it is located at the interior of the secured enclosure and is used only for egress from the enclosure.

Figure 1:
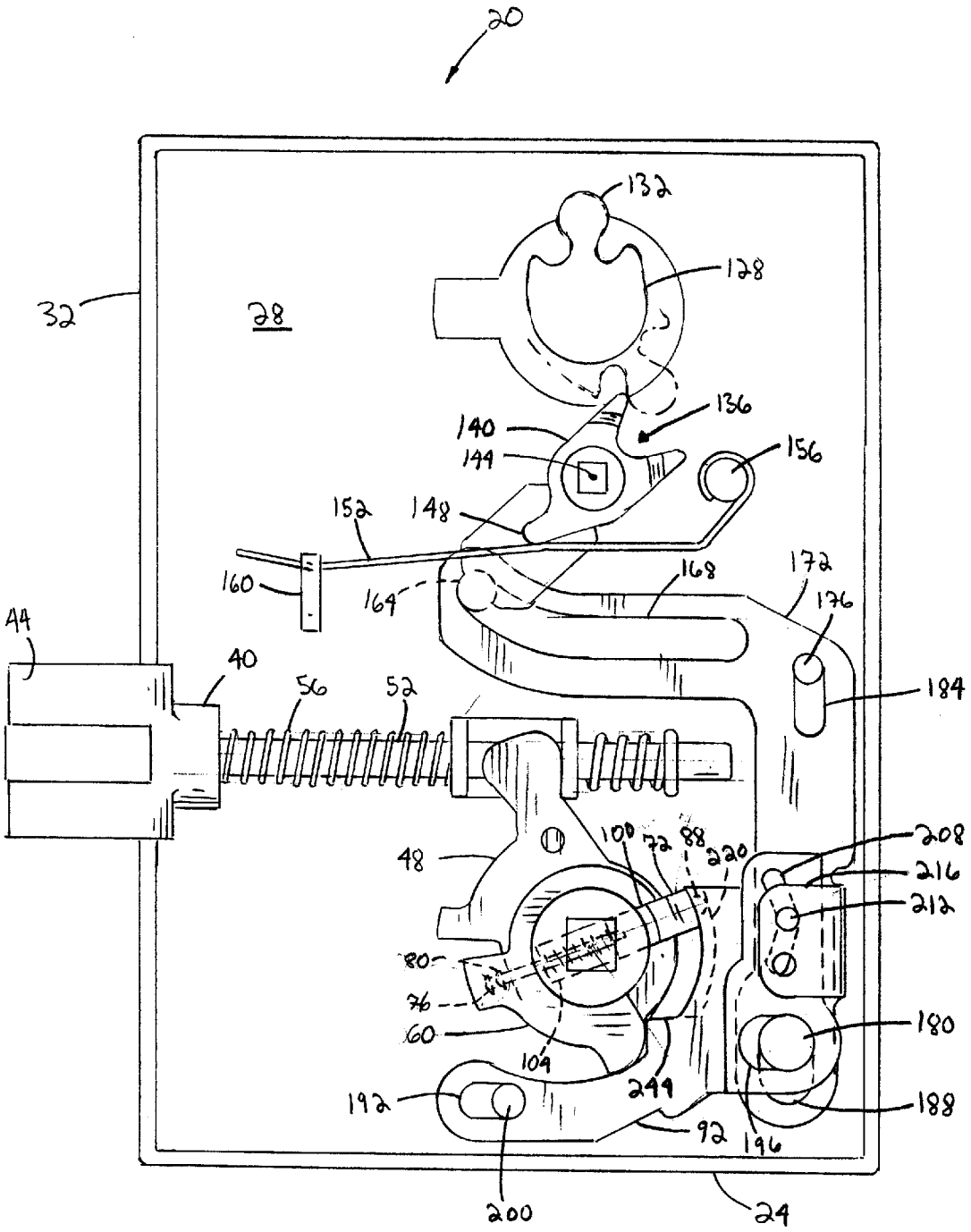
FIG. 1 is a broken away side view, as viewed from the outside (unsecured side) of a secured enclosure, illustrating the configuration of the respective components of a lock mechanism in an unlocked condition in accordance with one feature of the present invention before an operating lever is moved from its normally horizontal null position.
Figure 2:
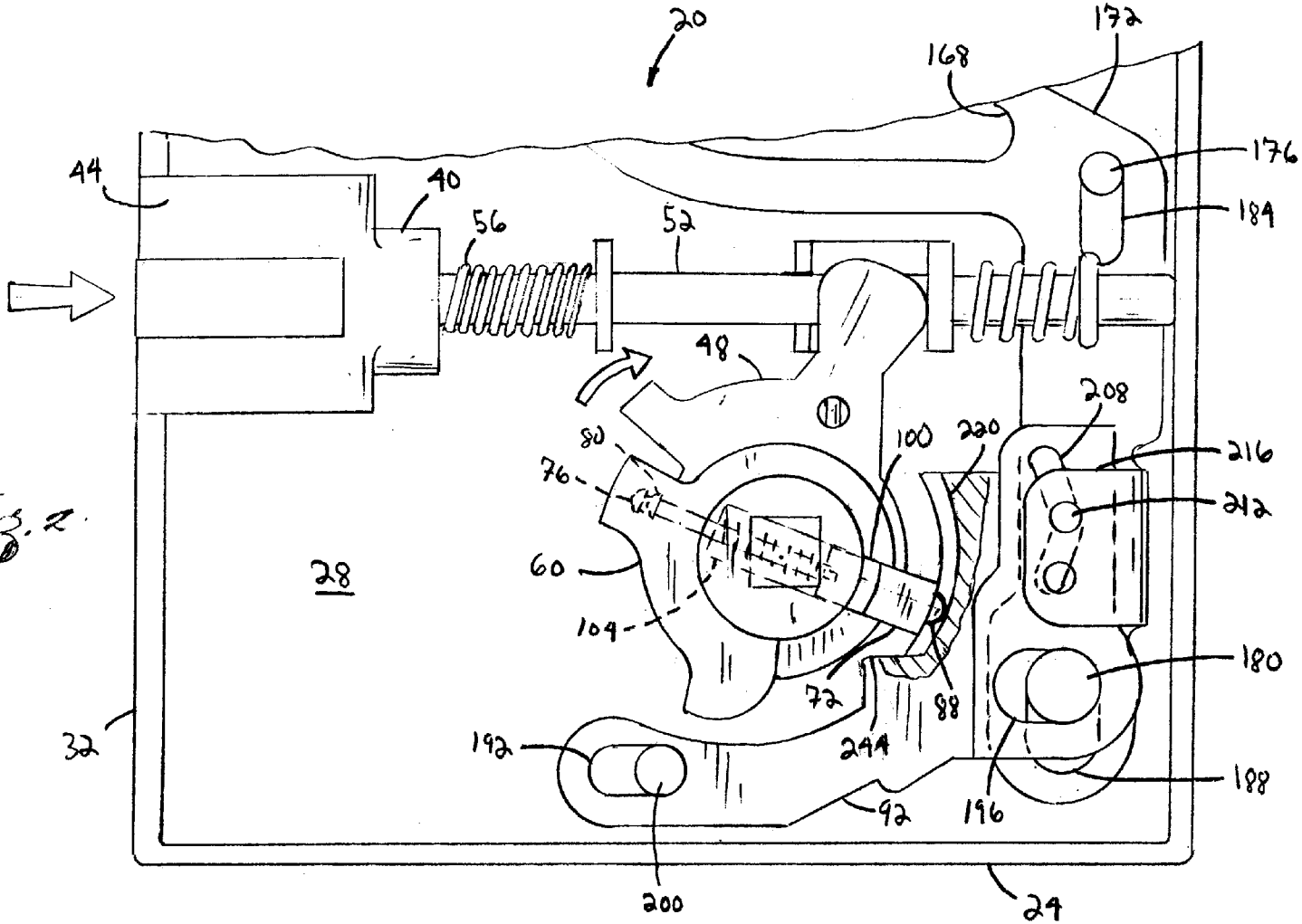
FIG. 2 is a fragmentary broken away side view, as viewed from the outside (unsecured side) of a secured enclosure, illustrating the configuration of the respective components of the lock mechanism shown in FIG. 1 in the unlocked condition after the operating lever has been moved from its normally horizontal position to retract the bolt.

Referring to FIG. 1, the lock mechanism 20 comprises a substantially rectangular lock case 24 that includes an integral backing plate 28. The case 24 provides a mounting surface for the components as well as a protective housing and a support for mounting the lock mechanism 20 in the mortise of a door. When the lock mechanism 20 is installed in the mortise of a door, a face plate 32 of the case 24 is flush with the latch edge of the door and disposed in opposing parallel relationship to the strike of the door frame when the door is closed.

Figure 5:
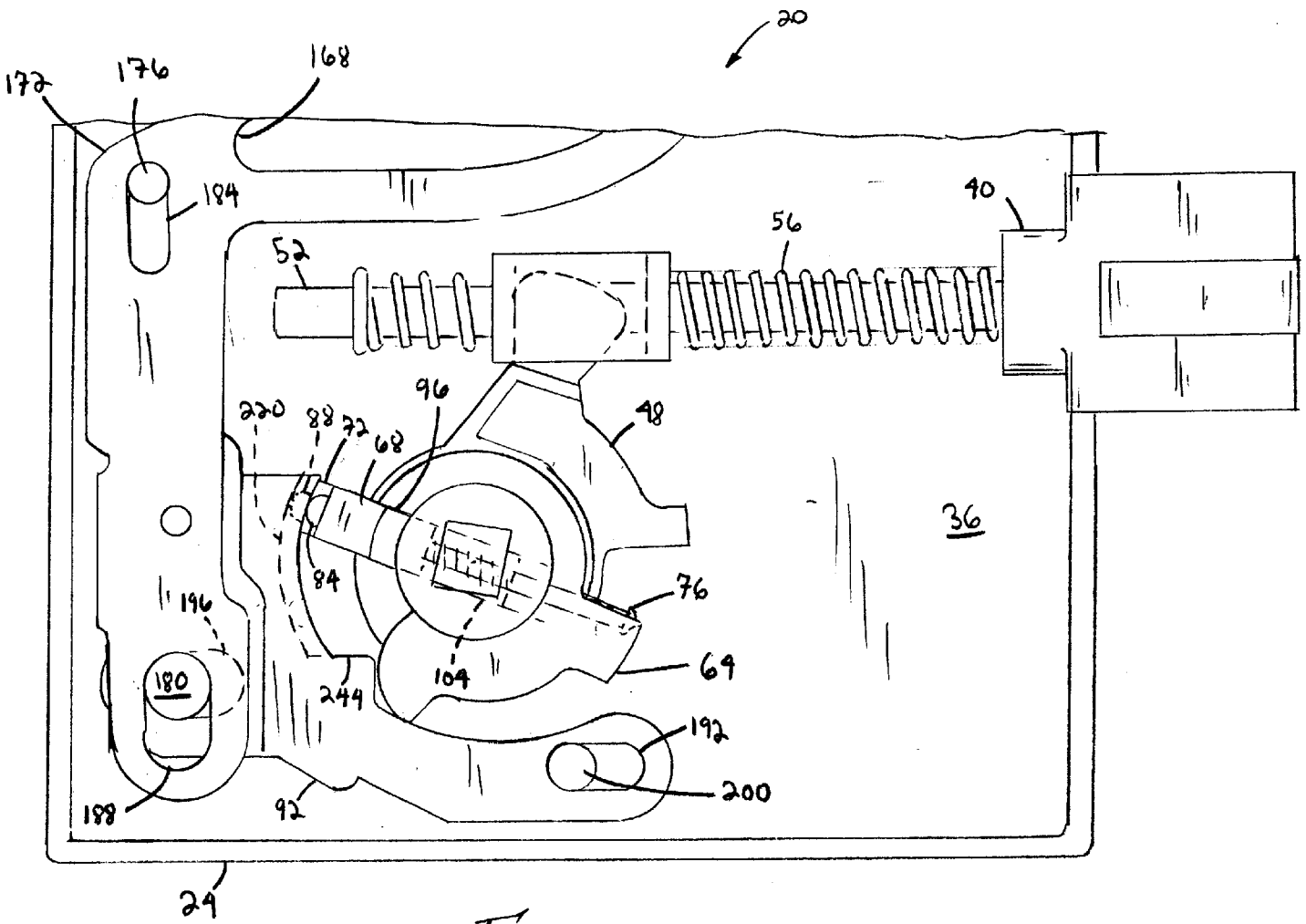
FIG. 5 is a fragmentary broken away side view, as viewed from the inside (secured) of the enclosure, illustrating the configuration of the respective components of the lock mechanism illustrated in FIG. 1 in the unlocked condition before the operating lever is moved from its normally horizontal null position.

FIGS. 1–4 illustrate the lock mechanism 20 with a front plate 36 (see FIG. 5) of the lock case 24 removed, so the internal components can be viewed. Conversely, FIG. 5 illustrates the opposite side of the lock mechanism 20 with the integral backing plate 28 removed and the front plate 36 exposed. When assembled, the lock mechanism 20 may be installed in a rectangular mortise typical of any conventional mortise lockset.

The lock mechanism 20 includes a latch or bolt 40 that is preferably a generally rectangular member having a short beveled free end 44. In some forms of the invention, the bolt 40 may have a curved surface at the projected or outer end. The outer end may further include a recessed roller (not shown). Conventionally, the latch of a self-latching lock mechanism typically has a beveled outer end. As a door closes, the beveled surface of the latch engages the strike of the door frame and is forced back into the lock mechanism until the door reaches a position in which the latch can project into the latch opening in the strike. This has been the typical operation of a self-latching lock mechanism and has dictated the need for a large beveled surface on the outer end of the latch.

A lock mechanism, in accordance with another form of the present invention, achieves self-latching convenience without need for a large beveled surface on the latch or the typically short latch throw of prior art self-latching lock mechanisms.

The access control features of the lock mechanism 20 are best initially explained with reference to FIGS. 1–5. A pivotally mounted retraction lever 48 is mechanically coupled to a reciprocally mounted throw rod 52 so that pivotal movement of the retraction lever 48 will overcome the bias of a spring 56 that urges the bolt 40 to the extended position. Accordingly, this movement in the direction of the arrows in FIG. 2 causes the bolt 40 to retract. In a first feature of the preferred embodiment, egress is desired from the inside (secured) of the door at all times. This first feature of the preferred embodiment will be discussed thoroughly herein. To facilitate this feature of the preferred embodiment, the retraction lever 48 is selectively rotatably coupled to an outside cam 60 under certain circumstances. (The term "outside" of course refers to the unsecured side for purposes of describing the first feature of the preferred embodiment. For a second feature of the preferred embodiment, the term "outside" refers to the same side of the door as in the first feature of the preferred embodiment, however, the "outside" refers to the secured side). The outside cam 60 is pivotable by an outside operating lever (not shown), which is disposed on the outside (unsecured) of the door. Similarly, the retraction lever 48 is rotatably coupled to an inside cam 64 at all times. The inside cam 64 is pivotable by an inside operating lever (not shown), which is disposed on the inside (secured) of the door. Because it is desired that egress from the secured room be available at all times, the inside cam 64 rotatably retracts the retraction lever 48 at all times.

The coupling of the inside and outside cams 64, 60 to the retraction lever 48 is governed by an L-shaped inside locker 68 and an L-shaped outside locker 72, respectively. The inside and outside lockers 68, 72 receive a reciprocally mounted engagement or inside locking pin 76 and a reciprocally mounted engagement or outside locking pin 80, respectively. The inside and outside locking pins 76, 80 are carried on the retraction lever 48. The inside locker 68 includes an inside convex head 84 and the outside locker 72 includes an outside convex head 88. The inside and outside convex heads 84, 88 engage a displaceable locking driver 92, which functions as a cam follower. The contour and physical position of the locking driver 92 determines the axial position of the inside and outside locking pins 76, 80. The axial positions of the inside and outside locking pins 76, 80 determine the relative positions of the inside and outside lockers 68, 72 with respect to the inside and outside cams 64, 60, respectively. The axial position of the inside and outside locking pins 76, 80 also determines the relative position of the inside and outside lockers 68, 72 with respect to an inside shoulder 96 on the inside cam 64 and an outside shoulder 100 on the outside cam 60, respectively.

Figure 6:
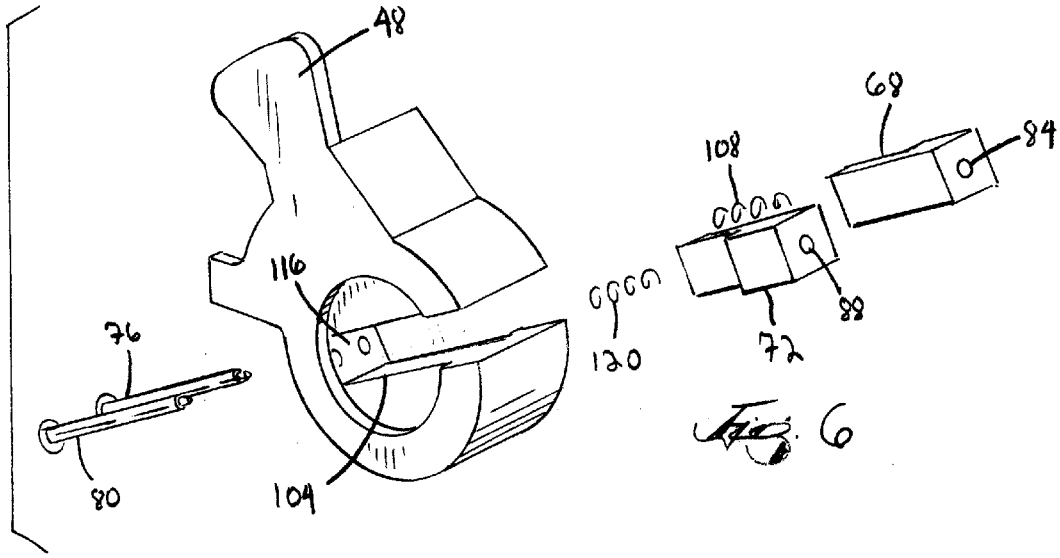
FIG. 6 is an outside exploded perspective view of a portion of the components of the lock mechanism illustrated in FIG. 1.

Referring to FIG. 6, the retraction lever 48 includes a slot 104 in which the inside and outside lockers 68, 72 slide within. An inside spring 108 is positioned between a back surface (not shown) of the inside locker 68 and a surface 116 of the retraction lever 48. An outside spring 120 is positioned between a back surface (not shown) of the outside locker 72 and the surface 116 of the retraction lever 48. Both springs 108, 120 are in a compressed condition (see FIGS. 9–10 and 12–13), and therefore, bias the inside and outside lockers 68, 72 toward the locking driver 92.

Figure 3:
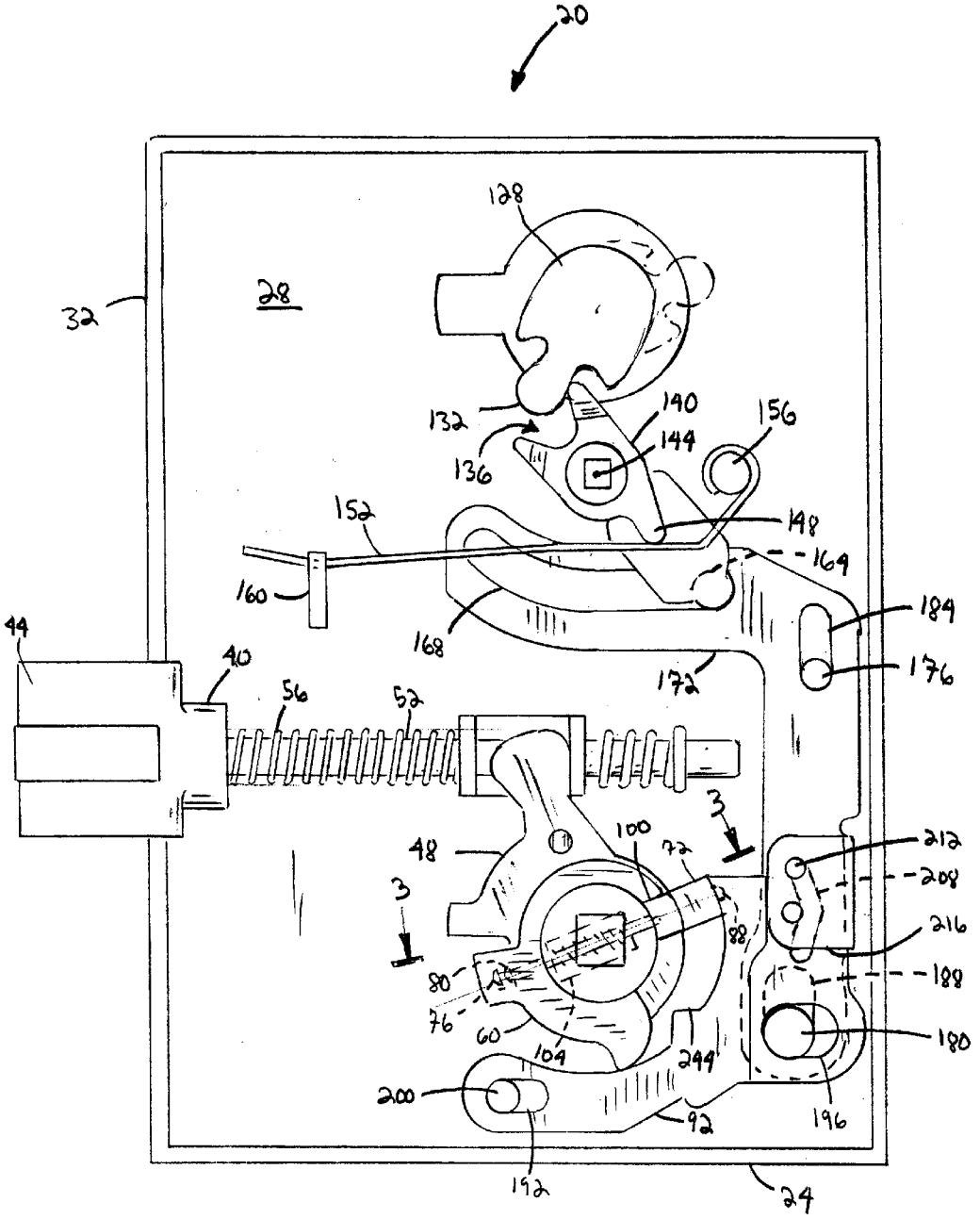
FIG. 3 is a broken away side view, as viewed from the outside (unsecured) of a secured enclosure, illustrating the configuration of the respective components of the lock mechanism shown in FIG. 1 in a locked condition before the operating lever is moved from its normally horizontal null position.
Figure 4:
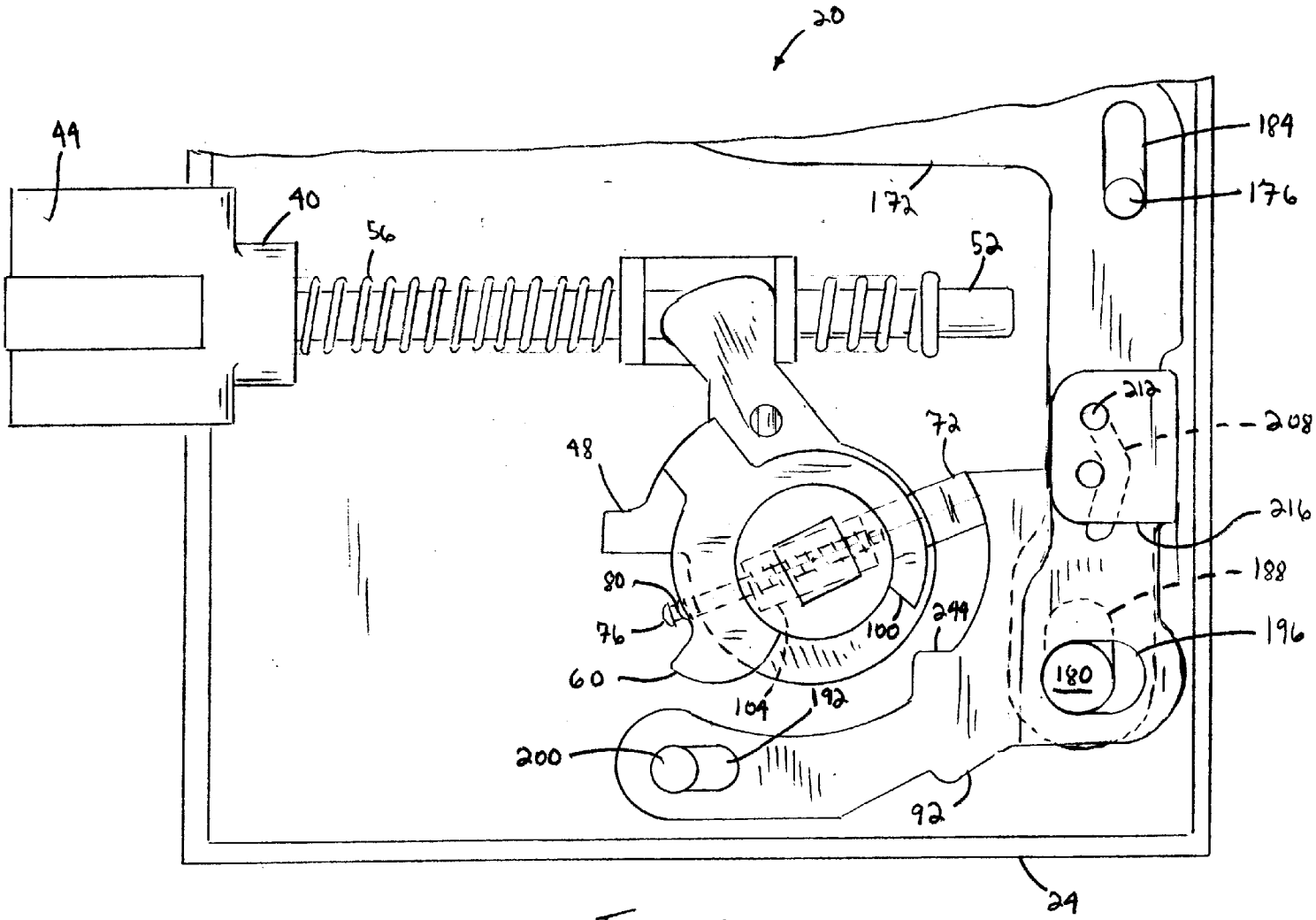
FIG. 4 is a fragmentary broken away side view, as viewed from the outside (unsecured) of the enclosure, illustrating the configuration of the respective components of a lock mechanism shown in FIG. 1 in the locked condition after the operating lever has been moved from its normally horizontal position.

The lock mechanism 20 will best be understood by reference first to FIGS. 1–4, consideration of the respective modes of operation in these figures and comparison of the positions of the respective elements. FIG. 1 is a side view, as viewed from the outside (unsecured side) of a room, illustrating the configuration of the respective components after the lock mechanism 20 has been unlocked either by a key from the outside or a thumb turn (not shown) from the inside of the room secured by the lock mechanism 20 and before the operating lever is moved from its normally horizontal position. More particularly, an arm 128 having a circular extremity or nose 132 is pivotally mounted as best seen at the top of FIGS. 1 and 3. Thus, the position shown in a dashed line in FIG. 1 is the position corresponding to the unlocked condition as determined by the key (not shown) in cooperation with a lock cylinder or thumb turn (not shown). In this mode the operating lever may be a lever, doorknob or other conventional operator (none illustrated) that connects via a spindle (not shown) for operating the bolt 40.

In the operating mode illustrated in FIG. 3, the arm 128 with the nose 132 has been rotated clockwise (as viewed) in response to locking by a key and lock cylinder or the thumb turn (not shown). A detailed comparison of FIGS. 1 and 3 provides an understanding of respectively the unlocked and locked conditions and the impact on the mechanical linkage extending from the arm 128 to the inside and outside convex heads 84, 88. It is this linkage in combination with the inside and outside lockers 68, 72, the inside and outside locking pins 76, 80, and the inside and outside shoulders 96, 100 of the inside and outside cams 64, 60, respectively, that constitutes the locking/unlocking mechanism controller responding to movement of an operating lever (not shown) disposed on the outside of the room secured by the lock mechanism 20. More specifically, this mechanism will (a) couple an operating lever in a manner that results in withdrawal of the bolt 40 when the operating lever (not shown) is rotated from a null horizontal position and the arm 128 is in the unlocked condition and (b) uncouple an operating lever in a manner that results in no motion of the bolt 40 when the operating lever is rotated from a null position and the arm 128 is in the locked condition.

The nose 132 of the arm 128 cooperates with a recess 136 of a bistable arm 140 that is pivotally mounted for movement around an axis 144. The bistable arm 140 has a nose 148 that abuts a leaf spring 152. The leaf spring 152 extends around a post 156 and is supported by a support 160. Thus, a key and cylinder or the thumb turn (not shown) causes rotation of the arm 128, which in turn causes the bistable arm 140 to move from the position shown in FIG. 1 to the position shown in FIG. 3. As will be apparent by inspection of the drawings, when the bistable arm 140 is disposed in a generally vertical position (the midway point between the positions shown in FIGS. 1 and 3), the spring 152 imposes a maximum force that is substantially vertical. Thus, the force imposed by the spring 152 on the rounded nose 148 produces two stable positions of the bistable arm 140. Accordingly, as a person rotates either the thumb turn (not shown) or the key and cylinder, the bistable arm 140 will by virtue of the force imposed by the leaf spring 152 naturally assume either the position illustrated in FIG. 1, corresponding to an unlocked condition, or the position in FIG. 3, corresponding to a locked condition.

The lower (as viewed) extremity of the bistable arm 140 has a laterally extending cylindrical surface 164 that is dimensioned and configured for engaging a curved slot 168 in an L-shaped arm 172. The L-shaped arm 172 is carried by pins 176, 180 that engage respective elongated parallel slots 184, 188 in the L-shaped arm 172. Accordingly, pivotal motion of the bistable arm 140, about the axis 144 in a counterclockwise direction (as viewed in FIGS. 1 and 3), causes the cylindrical surface 164 to move between the positions illustrated respectively in FIGS. 1 and 3. In other words, the cylindrical surface 164 moves from the left axial extremity to the right axial extremity of the slot 168. As a result, the vertical leg of the L-shaped arm will move upward to the position illustrated in FIG. 3 from the position illustrated in FIG. 1.

Figure 7:
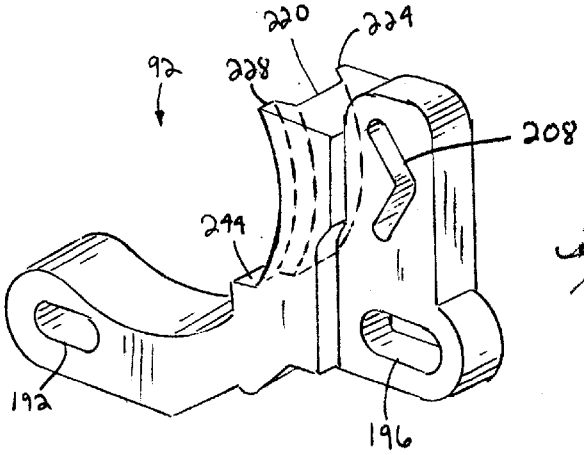
FIG. 7 is an outside perspective view of a locking driver of the lock mechanism illustrated in FIG. 1.

Also referring to FIG. 7, the locking driver 92 is provided with two elongated parallel slots 192, 196 that engage respectively a pin 200 carried by the backing plate 28 and the pin 180 also carried by the plate 28. The pin 180, as described above, also supports the L-shaped arm 172. An elongated oblique slot 208 in the locking driver 92 cooperates with a pin 212 and a clevis 216, which is interconnected with the L-shaped arm 172, to translate the vertical motion of the L-shaped arm 172 into a horizontal (as viewed) movement of the locking driver 92. The locking driver 92 also includes a curved channel 220 defined therein. The channel 220 is bordered by two projecting surfaces 224, 228.

Figure 8:
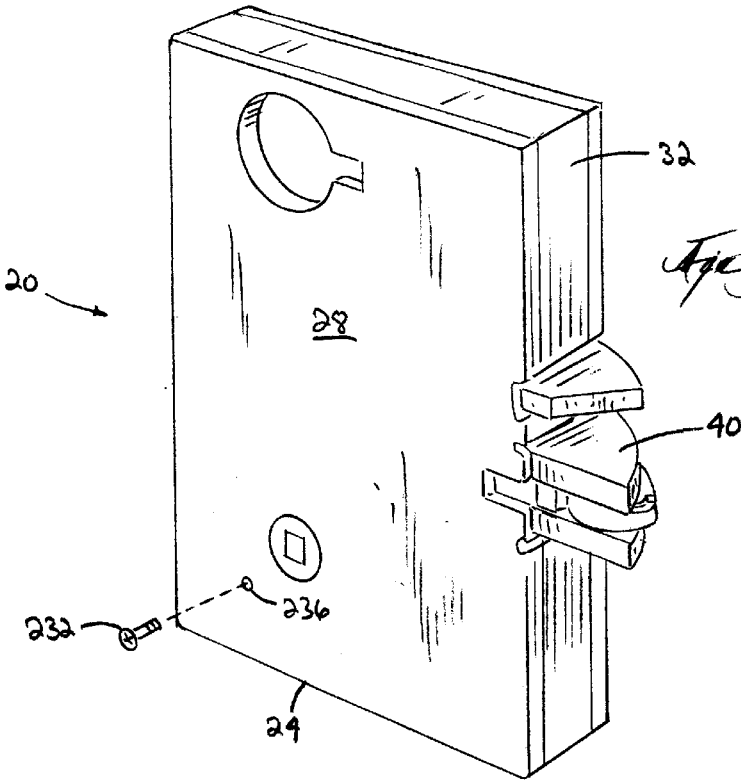
FIG. 8 is an outside perspective view of the lock mechanism illustrated in FIG. 1 including a front plate.
Figure 9:
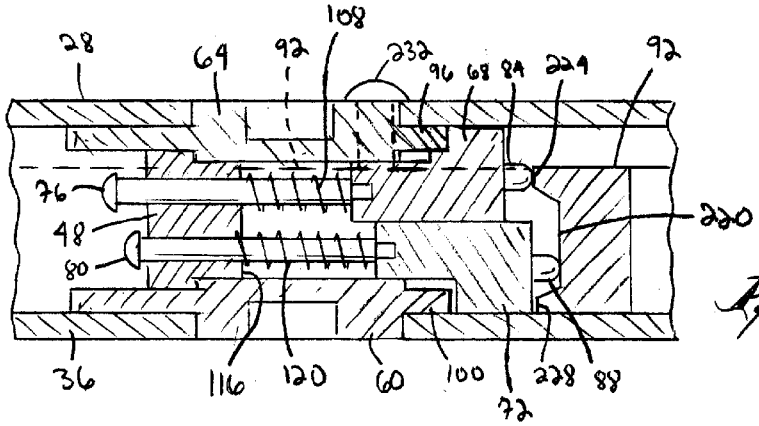
FIG. 9 is a partial section view along line 3—3 of the lock mechanism illustrated in FIG. 3 in the locked condition in accordance with one feature of the present invention.
Figure 10:
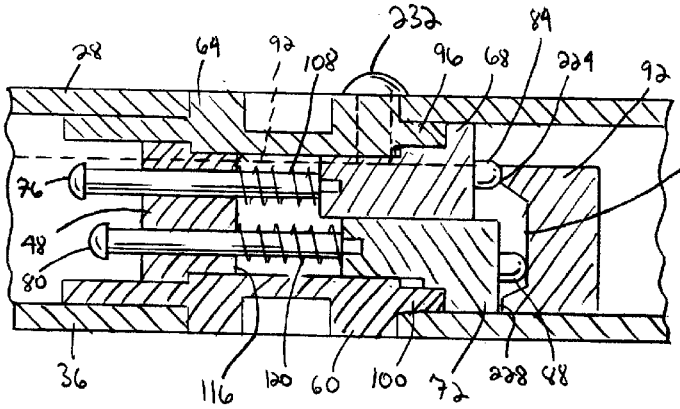
FIG. 10 is a partial section view containing the same components as illustrated in FIG. 9 in the unlocked condition in accordance with one feature of the present invention.

Referring to FIGS. 8–10, the first feature of the preferred embodiment will be discussed in greater detail. As noted above, the first feature of the preferred embodiment is to enable egression from the inside (secured) of the door at all times. For this feature, a screw 232 is threaded into an aperture 236 in the backing plate 28. The screw 232 biases the locking driver 92 away from the backing plate 28 and toward the front plate 36 when the screw 232 is completely threaded into the aperture 236. Biasing the locking driver 92 toward the front plate 36 aligns the inside convex head 84 with one of the projecting surfaces 224 and aligns the outside convex head 88 within the channel 220. The inside and outside springs 108, 120 respectively bias the inside and outside lockers 68, 72 toward the projecting surface 224 and the channel 220, respectively, ensuring constant contact between the lockers 68, 72 and the locking driver 92. Since the outside convex head 88 is aligned within the channel 220 and the inside convex head 84 aligns with the projecting surface 224, the outside locker 72 is biased further to the right (as viewed) than the inside locker 68.

Referring to FIG. 9, the lock mechanism is illustrated in the locked condition. Accordingly, the outside locker 72 is far enough to the right (as viewed) to prevent engagement of the outside locker 72 with the outside shoulder 100 of the outside cam 60. Thus, movement of the outside operating lever does not cause the bolt 40 to retract. As noted above, the inside locker 68 contacts the projecting surface 224, which prevents the inside locker 68 from being biased to the right as far as the outside locker 72. Accordingly, the inside locker 68 engages the inside shoulder 96 of the inside cam 64 in the locked condition.

Conversely, movement of the nose 132 by pivotal counterclockwise motion of the arm 128 to the position illustrated in FIG. 1, moves the lock mechanism to the unlocked condition, as illustrated in FIG. 10, and forces the locking driver 92 to move to the left (as viewed) to cause engagement of the outside locker 72 with the outside shoulder 100 of the outside cam 60. Thus, applying a torque to obtain movement of the outside operating lever causes the bolt 40 to retract. Movement of the nose 132 by pivotal counterclockwise motion of the arm 128 to the position illustrated in FIG. 1, also forces the inside locker 68 to move to the left (as viewed). The inside locker 68 remains engaged with the inside shoulder 96 as the inside locker 68 moves to the left, therefore, the inside locker 68 engages the inside shoulder 96 at all times and applying a torque to obtain movement of the inside operating lever causes the bolt 40 to retract at all times.

Angular movement of the retraction lever 48 is limited by a stop 244 on the locking driver 92 as seen in FIGS. 1–5 and 7. Typically, the operating lever is rotated through an angle of approximately 60 degrees before the inside and outside lockers 68, 72 contact the stop 244 on the locking driver 92.

With reference to FIGS. 3 and 9, the lock mechanism 20 is illustrated in the locked condition according to the first feature of the preferred embodiment, wherein egress is desired from the inside (secured) of the door at all times and egress is selectively desired from the outside (unsecured) of the door. The outside locker 72 does not engage the outside shoulder 100 of the outside cam 60, therefore, allowing the outside operating lever to move without retracting the bolt 40. The inside locker 68 engages the inside shoulder 96 of the inside cam 64 while the lock mechanism 20 is in the locked condition, therefore, allowing the inside operating lever to move and retract the bolt 40.

With reference to FIGS. 1 and 10, the lock mechanism 20 is illustrated in the unlocked condition according to the first feature of the preferred embodiment, wherein egress is desired from the inside (secured) of the door at all times and egress is selectively desired from the outside (unsecured) of the door. The outside locker 72 engages the outside shoulder 100 of the outside cam 60, therefore, allowing the outside operating lever to move and retract the bolt 40. The inside locker 68 remains in engagement with the inside shoulder 96 of the inside cam 64, therefore, allowing the inside operating lever to move and retract the bolt 40 in both the locked and unlocked conditions.

Figure 12:
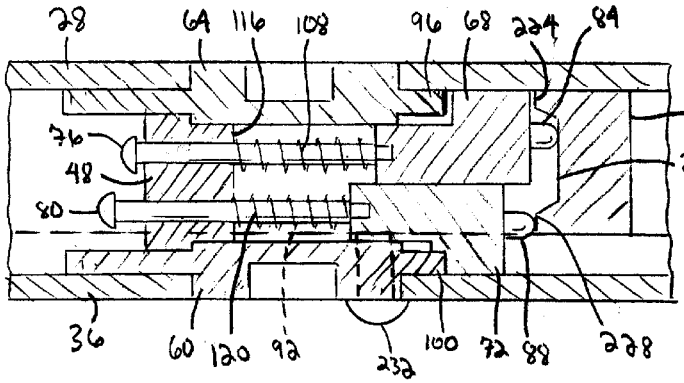
FIG. 12 is a partial section view containing the same components as illustrated in FIG. 9 in a locked condition in accordance with the second feature of the present invention.
Figure 11:
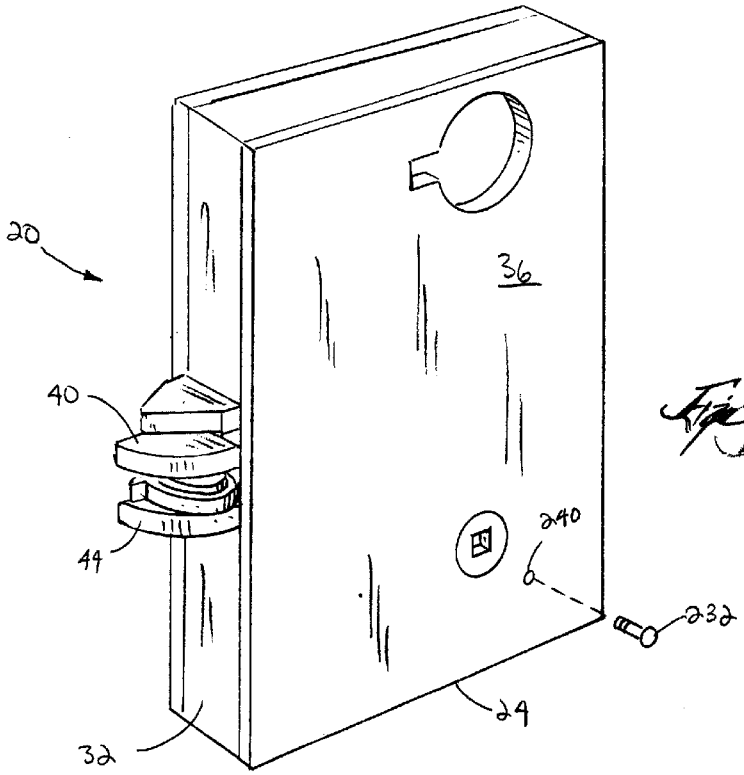
FIG. 11 is an inside perspective view of the lock mechanism in accordance with a second feature of the present invention.
Figure 13:
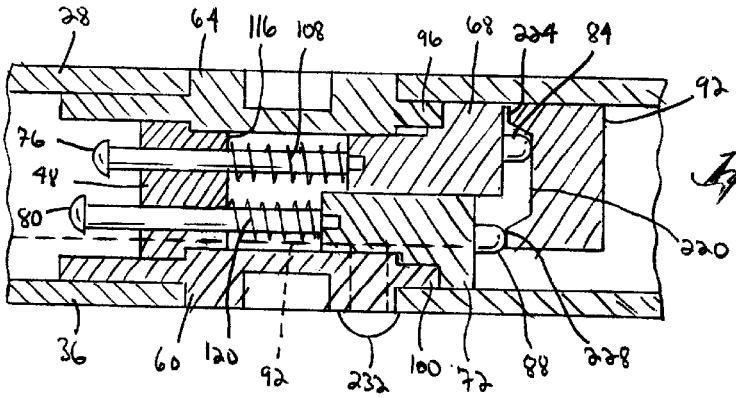
FIG. 13 is a partial section view containing the same components as illustrated in FIG. 9 in an unlocked condition in accordance with the second feature of the present invention.

FIGS. 11–13 illustrate the second feature of the preferred embodiment. The second feature of the preferred embodiment enables egression from the outside (secured) of the door at all times and selectively enables egression from the inside (unsecured). This second feature of the preferred embodiment is opposite of the first feature discussed above, such that, the outside of the door is the secured side and the inside of the door is the unsecured side. In this second feature, the screw 232 is threaded into an aperture 240 in the front plate 36. The screw 232 biases the locking driver 92 away from the front plate 36 and toward the backing plate 28. Biasing the locking driver 92 toward the backing plate 28 aligns the outside convex head 88 with one of the projecting surfaces 228 and aligns the inside convex head 84 within the channel 220.

Referring to FIG. 12, the lock mechanism is illustrated in the locked condition. The inside locker 68 is far enough to the right (as viewed) to prevent engagement of the inside locker 68 with the inside shoulder 96 of the inside cam 64. Thus, movement of the inside operating lever does not cause the bolt 40 to retract. As noted above in the second feature of the preferred embodiment, the outside locker 72 is aligned with the projecting surface 228. Accordingly, the outside locker 72 is not biased as far to the right (as viewed) as the inside locker 68. Therefore, the outside locker 72 engages the outside shoulder 100 of the outside cam 60 and applying a torque to obtain movement of the outside operating lever causes the bolt 40 to retract.

Conversely, movement of the nose 132 by pivotal counterclockwise motion of the arm 128 to the position illustrated in FIG. 1, moves the lock mechanism to the unlocked condition, as illustrated in FIG. 13, and forces the locking driver 92 to move to the left (as viewed) to cause engagement of the inside locker 68 with the inside shoulder 96 of the inside cam 64. Thus, applying a torque to obtain movement of the inside operating lever causes the bolt 40 to retract. Movement of the nose 132 by pivotal counterclockwise motion of the arm 128 to the position illustrated in FIG. 1, also forces the outside locker 72 to move to the left (as viewed). The outside locker 72 remains engaged with the outside shoulder 100 as the outside locker 72 moves to the left, therefore, the outside locker 72 engages the outside shoulder 96 at all times and applying a torque to obtain movement of the outside operating lever causes the bolt 40 to retract at all times.

The springs 108, 120 and the lockers 68, 72 cooperate to prevent jamming or other potential malfunctioning of the lock mechanism 20. Under some conditions, wear, tolerance buildup, or imprecise assembly that would involve the lockers 68, 72, the locking driver 92 and other components could result in malfunctions such as jamming. The springs 108, 120 provide a strong enough bias to overcome possible jamming and other potential malfunctions of the lock mechanism 20. The springs 108, 120 constantly bias the lockers 68, 72 toward the locking driver 92 and ensure that contact is upheld between the lockers 68, 72 and the locking driver 92.

When torque is applied to the operating lever, the force is transferred to the inside and outside shoulders 96, 100 (depending on the condition of the lock mechanism 20) and to the lockers 68, 72 which are also subject to a torque in the opposing direction exerted through the latch assembly and the retraction lever 48. In addition, because the locking driver 92 is displaced between the locked and unlocked conditions, the cam arcs of the channel 220 and the projecting surfaces 224, 228 may not be precisely concentric. The jamming could make the assembly inoperative and prevent access to the secured side of the door or even prevent egress from the secured side to the unsecured side. However, springs 108, 120 provide a strong enough bias of the lockers 68, 72 toward the locking driver 92 to prevent jamming and any other type of malfunctions due to wear, tolerance buildup, and imprecise assembly.

The invention has been described with respect to a mechanical embodiment. Those skilled in the art will recognize that the same type of override structure may be utilized in electromechanical embodiments. Thus, it must be understood that the lock mechanism in accordance with the present invention incorporates features making it compatible with both keyed and electronic access control systems.

While preferred embodiments of the foregoing invention have been set forth for purposes of illustration, the foregoing description should not be deemed a limitation of the invention herein. Accordingly, various modifications, adaptations, equivalents and alternatives may occur to one skilled in the art without departing from the spirit and the scope of the invention.

I claim:

1. A lock mechanism having a locked condition and an unlocked condition, the lock mechanism comprising:

a housing;

a latch coupled to the housing and having an extended position and a retracted position;

a latch biasing member for biasing the latch toward the extended position;

a locking driver having a first surface and a second surface offset from one another;

a locker engageable with at least one of the first and second surfaces of the locking driver; and a biasing member for biasing the locker toward and into engagement with at least one of the first and second surfaces of the locking driver.

2. The lock mechanism as claimed in claim 1, wherein at least one of the first and second surfaces is defined within the locking driver.

3. The lock mechanism as claimed in claim 2, wherein the first and second surfaces are arced surfaces.

4. The lock mechanism as claimed in claim 3, wherein the first and second surfaces are generally concentric.

5. The lock mechanism as claimed in claim 1, wherein the locker is a first locker and the biasing member is a first biasing member, the lock mechanism further comprising a second locker, the second locker including a second biasing member for biasing the second locker toward the other of the first and second surfaces.

6. The lock mechanism as claimed in claim 5, wherein the first locker is biased in a first direction and the second locker is biased in a second direction, the first and second directions being substantially similar.

7. The lock mechanism as claimed in claim 5, wherein the first locker further comprises a first pin and the second locker further comprises a second pin, the first biasing member being disposed in a generally coaxial relationship with the first pin, the second biasing member being disposed in a generally coaxial relationship with the second pin.

8. A lock mechanism having a locked condition and an unlocked condition, the lock mechanism comprising:

a housing;

a latch coupled to the housing and having an extended position and a retracted position;

a displaceable locking driver having a first position corresponding to the unlocked condition and a second position corresponding to the locked position, the locking driver operable to transfer operator input motion to move the latch to the retracted position in the first position, the locking driver operable to uncouple the operator input motion from the latch in the second position; and a locker having a biasing member for biasing the locker toward and into engagement with the locking driver when the locking driver is in both the first and second positions, the locker being movable via the operator input motion and maintaining engagement with the locking driver throughout the movement of the locker.

9. The lock mechanism as claimed in claim 8, wherein the displaceable locking driver further comprises a first surface and a second surface, at least one of the first and second surfaces being defined within the displaceable locking driver.

10. The lock mechanism as claimed in claim 9, wherein the locker is a first locker and the biasing member is a first biasing member, the lock mechanism further comprising a second locker, the second locker including a second biasing member for biasing the second locker toward the locking driver.

11. The lock mechanism as claimed in claim 10, wherein the first locker is biased toward at least one of the first and second surfaces, and the second locker is biased toward the other of the first and second surfaces.

12. The lock mechanism as claimed in claim 10, wherein the first locker is biased in a first direction and the second locker is biased in a second direction, the first and second directions being substantially similar.

13. A lock mechanism having a locked condition and an unlocked condition, the lock mechanism comprising:

a housing;

a latch extending from the housing, the latch having an extended position and a retracted position;

an operating lever operable to provide an operator input motion to move the latch to the retracted position in the unlocked condition, the operator input motion being uncouplable from the latch in the locked condition;

a locking driver interconnectable with the housing, the locking driver including a first surface and a second surface, at least one of the first and second surfaces being defined within the locking driver;

a first locker interconnectable with the locking driver, the first locker including a first biasing member for biasing the first locker toward one of the first and second surfaces; and a second locker interconnectable with the locking driver, the second locker including a second biasing member for biasing the second locker toward the other of the first and second surfaces.

14. The lock mechanism as claimed in claim 13, wherein the locking driver is displaceable between a first position corresponding to the unlocked condition and a second position corresponding to the locked condition.

15. The lock mechanism as claimed in claim 13, wherein the first and second surfaces are arced surfaces.

16. The lock mechanism as claimed in claim 15, wherein the first and second surfaces are generally concentric.

17. The lock mechanism as claimed in claim 13, wherein the first locker is biased in a first direction and the second locker is biased in a second direction, the first and second directions being substantially similar.

18. The lock mechanism as claimed in claim 13, wherein the first locker further comprises a first pin and the second locker further comprises a second pin, the first biasing member being disposed in a generally coaxial relationship with the first pin, the second biasing member being disposed in a generally coaxial relationship with the second pin.

* * * * *